US007557281B1

(12) United States Patent
Campling

(10) Patent No.: US 7,557,281 B1
(45) Date of Patent: Jul. 7, 2009

(54) ADJUSTABLE NECK MOUNTING ASSEMBLY FOR A STRINGED INSTRUMENT

(75) Inventor: Nicholas John Campling, Peterborough (GB)

(73) Assignee: IBC Trading Limited, Norther Ireland (GB)

( * ) Notice: Subject to any disclaimer, the term of this patent is extended or adjusted under 35 U.S.C. 154(b) by 0 days.

(21) Appl. No.: 12/139,882

(22) Filed: Jun. 16, 2008

(30) Foreign Application Priority Data

May 21, 2008 (GB) ..... 0809174.6

(51) Int. Cl.
*G10D 3/00* (2006.01)

(52) U.S. Cl. ..... 84/293

(58) Field of Classification Search ..... 84/267, 84/290, 291, 293
See application file for complete search history.

(56) References Cited

U.S. PATENT DOCUMENTS 3,204,510 A 9/1965 Hopf
3,550,496 A 12/1970 Fender
4,295,403 A 10/1981 Harris
4,432,267 A 2/1984 Feller
5,353,672 A * 10/1994 Stewart ..... 84/291
5,421,233 A 6/1995 Bunker
5,458,035 A * 10/1995 Okamura ..... 84/293
5,469,770 A 11/1995 Taylor
6,051,766 A 4/2000 Taylor
6,265,648 B1 7/2001 Steinberger
7,112,733 B1 9/2006 Babicz
7,157,634 B1 1/2007 Babicz
2007/0012159 A1 1/2007 Babicz

* cited by examiner

*Primary Examiner*—Kimberly R Lockett
(74) *Attorney, Agent, or Firm*—Brooks Kushman P.C.

(57) ABSTRACT

An adjustable mounting assembly for mounting a neck to a body of a stringed instrument. The assembly comprises a first mounting to mount to the neck of the stringed instrument, a second mounting to mount to the body of the stringed instrument, and an adjuster mechanism interconnecting the first and second mountings and adapted to adjust and fix, in use, the relative position of the first and second mountings. The adjuster mechanism comprises a screw threaded member having a first threaded portion that is engaged in a corresponding threaded boss of the first mounting, and a second oppositely threaded portion that is engaged in a corresponding threaded boss of the second mounting.

23 Claims, 4 Drawing Sheets

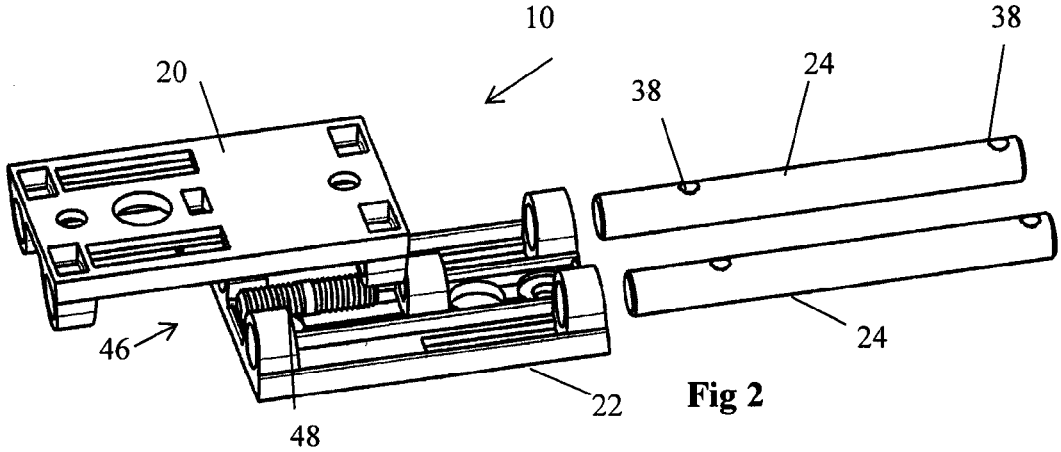
Fig 2
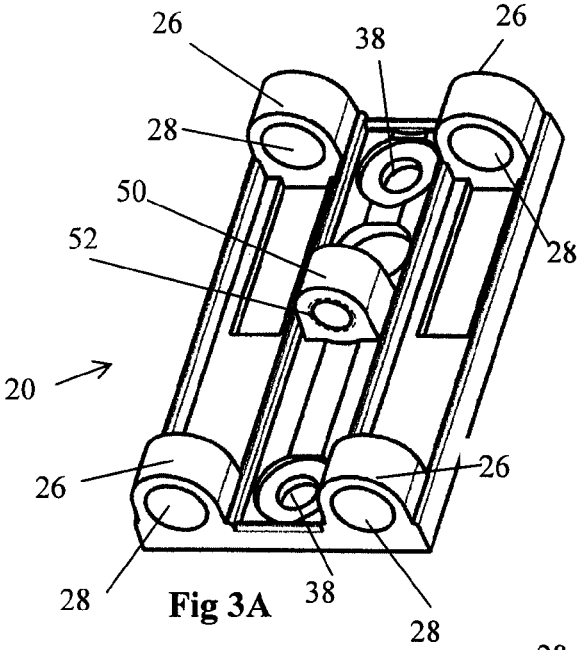
Fig 3A
Fig 3B
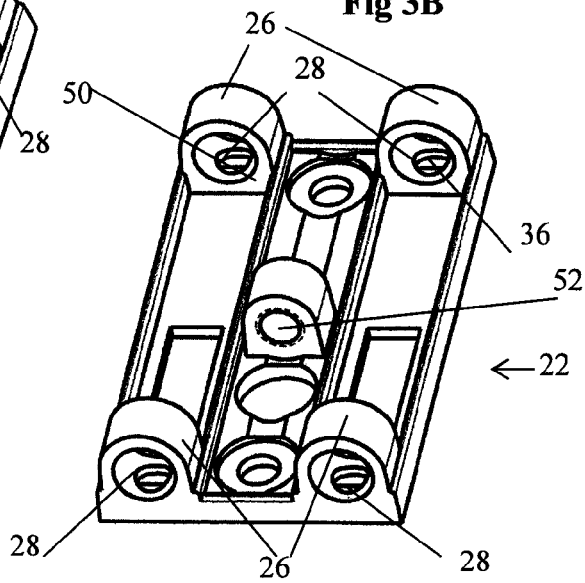
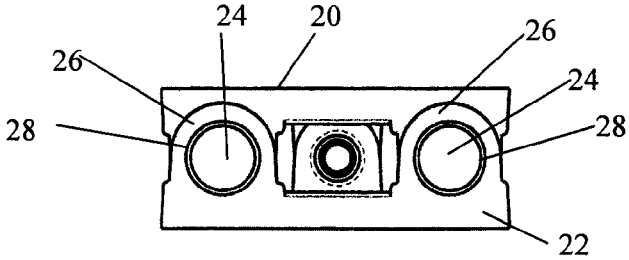
Fig 5

ADJUSTABLE NECK MOUNTING ASSEMBLY FOR A STRINGED INSTRUMENT

CROSS-REFERENCE TO RELATED APPLICATIONS

This application claims foreign priority benefits under 35 U.S.C. § 119(a)-(d) to GB 0809174.6, filed May 21, 2008 which is hereby incorporated by reference in its entirety.

BACKGROUND OF THE INVENTION

1. Field of the Invention

The present invention relates to stringed musical instruments of the type having an instrument body, a neck extending therefrom, and a plurality of strings attached at one end to the instrument body and at the other to the neck. More particularly the present invention relates to an adjustable arrangement for mounting the neck of the instrument to the body.

2. Background Art

Many stringed instruments, for example guitars, banjos, violins, cellos etc, include a body to which is attached, and from which extends, a neck. The strings are attached at one end to an end of the neck and at the other end to the body with the strings extending along and above a fingerboard surface of the neck. In use a player presses and clamps the strings against the fingerboard surface of the neck to alter the effective length of the string and change the pitch of the string. An important consideration in such a stringed instrument, and characteristic of how the instrument 'plays' is the height of the strings over the fingerboard of the neck, and so how far a player has to press the strings (the 'action' of the instrument). Different players may prefer different string heights. In addition, and relatedly, the height of the strings over the body of the instrument alters the sound produced.

Conventionally the neck is rigidly fixed to the body of the instrument. However, and in order to allow adjustment of the height of the strings over the fingerboard and body of the instrument, it has been proposed to adjustably connect the neck to the body of the instrument so that it can be moved relative to the body and strings to alter the height of the strings over the fingerboard surface of the neck.

In addition an adjustable connection of the neck to the body may have other advantages. In particular it can reduce stresses that may be induced and transmitted between the body and neck that may arise with a fixed connection between the neck and body. An adjustable connection provides a mechanical break and interface between the neck and body, and also allows adjustment to take out any such stresses that may develop. An adjustable arrangement may also allow removal of the neck from the body making transportation of the instrument, and repair and replacement of the neck/body easier.

The design of a suitable adjustable neck connection is however a significant challenge. In particular it is important that the neck is rigidly connected to the body to both withstand the tension applied by the strings. Since any movement can alter the length and tension of the strings so altering the pitch, it is desirable that the adjustment and movement of the neck is such that it does not, significantly alter the distance and length of the strings attached to the neck. It is also desirable that the angle of the neck relative to the body is also maintained. Typically such adjustable necks are slidably mounted to move in a direction normal to the strings and fingerboard surface. In some cases however the adjustment of the angle of the neck relative to the body can also be provided. The neck adjustment must also not significantly alter the sound produced, and in particular should not add any buzz or rattle, which can be a problem when a mechanical movable assembly is incorporated into a musical instrument. The number of parts should therefore be kept to a minimum, and as always costs and ease of manufacture need to be considered. The adjustment must also be relatively easy to adjust, whilst also being secure to maintain the adjusted position under the relatively high loads arising in normal use.

In view of these multiple considerations, a number of different adjustable neck arrangements have been proposed. Examples of such adjustable neck arrangements are described in U.S. Pat. No. 6,051,766, U.S. Pat. No. 4,295,403, U.S. Pat. No. 4,432,267, U.S. Pat. No. 5,421,233, U.S. Pat. No. 3,204,510, U.S. Pat. No. 3,550,496, U.S. Pat. No. 6,265,648 and U.S. Pat. No. 5,469,770 amongst others. A particular arrangement is described in U.S. Pat. No. 7,157,634, and related publication US 2007/0107579. While these arrangements variously provide a suitable adjustable neck mounting (s) with various advantages, they also have a number of respective disadvantages and they can be improved. Indeed the number of prior proposals indicates that there is scope for such improvements and alternatives due to the challenging requirements.

SUMMARY

It is therefore desirable to provide an adjustable neck mounting device for a stringed instrument which addresses the above described problems and requirements and/or which more generally offers improvements or an alternative to such existing arrangements.

According to the present invention there is therefore provided an adjustable neck mounting device for a stringed instrument, and a stringed instrument including such an adjustable neck mounting, as described in the accompanying claims.

BRIEF DESCRIPTION OF THE DRAWINGS

The present invention will now be described by way of example only with reference to the following figures in which:

FIG. 2 is a more detailed exploded perspective illustration of the adjustable neck mounting assembly shown in FIG. 1;

FIGS. 3A and 3B are perspective view of the neck and body mounting plates respectively of the adjustable neck mounting assembly shown in FIG. 2;

FIG. 5 is an end view of the assembled adjustable neck mounting assembly shown in FIG. 4;

DETAILED DESCRIPTION

Figure 1:
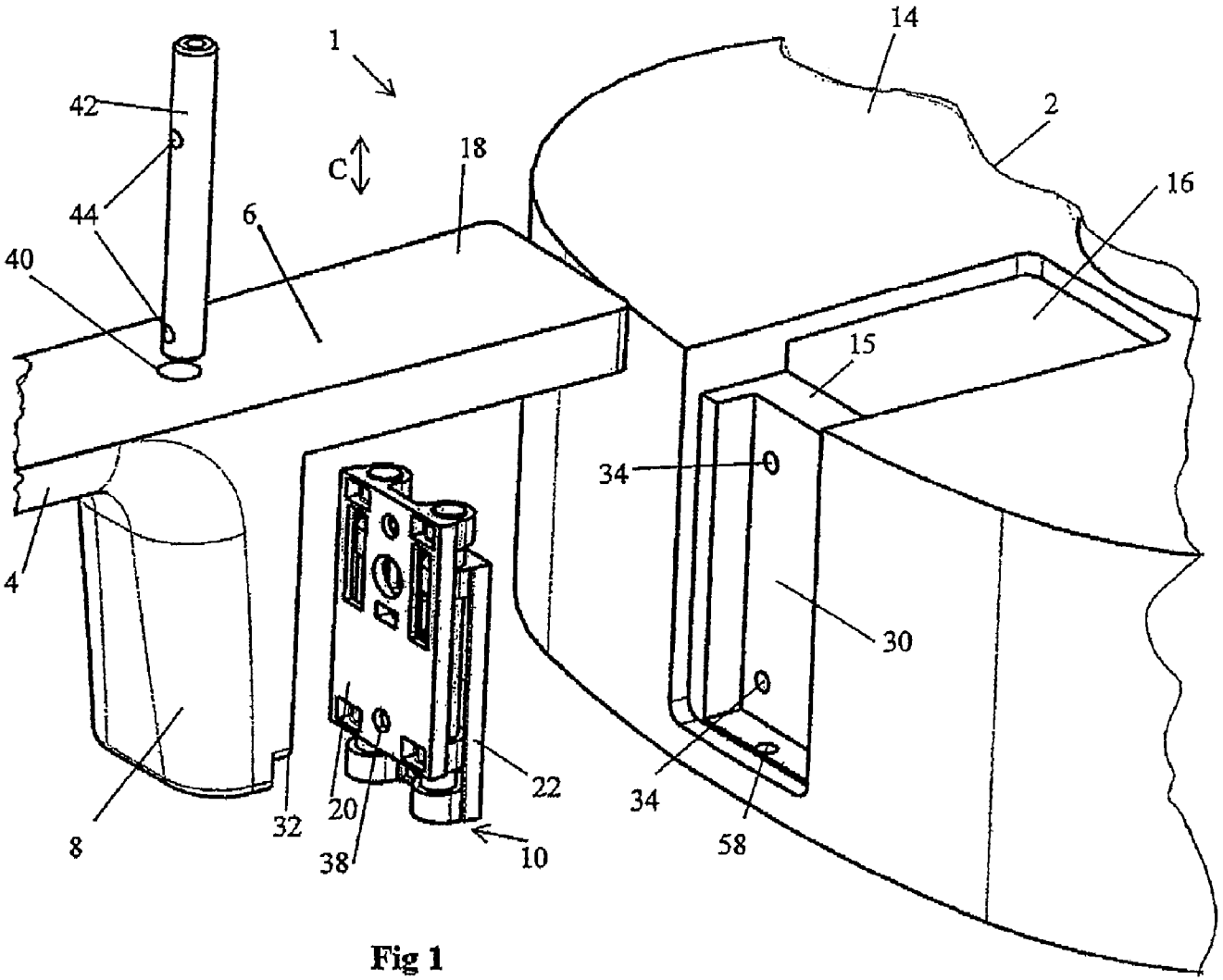
FIG. 1 is an exploded perspective part view of a stringed instrument body, neck and an adjustable neck mounting assembly in accordance with an embodiment of the invention.

In an embodiment of the invention there is provided an adjustable mounting assembly for mounting a neck to a body of a stringed instrument. The assembly comprises a first mounting adapted to be mounted to the neck of the stringed instrument, a second mounting adapted to be mounted to the body of the stringed instrument, and an adjuster mechanism interconnecting the first and second mountings and adapted to adjust and fix, in use, the relative position of the first and second mountings. The adjuster mechanism comprises a screw threaded member having a first threaded portion that is engaged in a corresponding threaded boss of the first mounting, and a second oppositely threaded portion that is engaged in a corresponding threaded boss of the second mounting, and a means to rotate the screw threaded member within the threaded bosses.

Such an assembly comprises a relatively self contained unit to adjustably connect, via the mountings, the neck of a stringed instrument to the body of a stringed instrument such that the neck position can be adjusted relative to the body. The assembly provides a practical alternative to such existing arrangements. The assembly and double opposing threads on the screw threaded member provide a dual adjustment action acting to move and operate on both the neck and body. This increases the adjustment movement provided and also locking friction. In particular in use the adjuster mechanism, and its engagement with the mountings acts and moves axially relative to both mountings rather than relative to just one. In some arrangements the adjustment assembly is relatively self contained, and can readily be fitted to conventional existing instruments, for example, guitars, with relative little modification. The assembly also comprises relatively few parts, and is relatively simple and easy to manufacture.

The first and second threaded portions may be provided at opposite ends of the screw threaded member. The first threaded portion and corresponding threaded boss may have a right-hand thread, and the second threaded portion and corresponding boss may have an opposite left-hand thread.

The screw threaded member may be located in between the first and second mountings. In one embodiment, the screw threaded member is located centrally in between the first and second mountings.

This location of the screw thread protects the screw thread and threads within the assembly.

The first mounting may be slidingly engaged with the second mounting. More specifically the assembly may further comprise at least one guide attached to one of the first or second mountings and along which the other mounting is moveably guided. The at least one guide may comprise at least one guide rod attached to the first or second mounting, and axially along which the other of the second or first mounting is slidingly engaged. In one embodiment, the at least one guide comprises a pair of spaced apart parallel guides, and the screw threaded member is also located between the pair of parallel guides. Furthermore, the screw threaded member may be located parallel to the at least one guide.

The guides, in particular parallel guide rods, provide a strong rigid connection and fixing between the mountings, and so in use between the neck and body whilst allowing the required movement. The guide rods furthermore provide such a guidance and connection in a simple and robust manner.

The means to rotate the screw threaded member may comprise configuring an end of the screw threaded member to receive and engage a corresponding tool. In particular, the end of the screw threaded member may comprise a socket, head or slot adapted to be engaged by a corresponding tool.

The first and second mountings may be substantially identical, and may be formed from an identical casting. This simplifies manufacture and reduces costs.

In another aspect of an embodiment of the invention there is provided a stringed instrument comprising an instrument body, an instrument neck, and the adjustable mounting assembly as described above interconnecting the instrument neck with the instrument body, the first mounting connected to the neck and the second mounting connected to the instrument body.

The neck may include a heel, and the first mounting of the adjustable mounting assembly is preferably connected to said heel. A recess may also be defined in the neck and/or body for receiving the adjustable mounting assembly.

An access opening may be provided in the neck or body of the instrument to provide access to, in use rotate the screw threaded member.

The neck may comprise a fingerboard surface and the adjustable mounting assembly connects the neck to the body such that the neck is adjustable in a direction generally perpendicularly to the fingerboard surface.

As a result the adjustable mounting assembly and adjustment of the neck relative to the body allow the height of the strings which typically extend over the fingerboard to be adjusted and the action of the instrument to be altered to a players preference.

In the following description of the invention, certain terminology will be used for the purpose of reference only, and are not intended to be limiting. Terms such as "upper", "lower", "above", "below", "rightward", "leftward", "clockwise", and "counterclockwise" refer to directions in the drawings to which reference is made. Terms such as "inward" and "outward" refer to directions toward and away from, respectively, the geometric centre of the component described. Terms such as "front", "rear", "side", "leftside", "rightside", "top", "bottom", "horizontal", and "vertical" describe the orientation of portions of the component within a consistent but arbitrary frame of reference which is made clear by reference to the text and the associated drawings describing the component under discussion. Such terminology will include the words specifically mentioned above, derivatives thereof, and words of similar import.

Referring to FIG. 1 a stringed instrument 1, for example as showing a guitar, comprises a body 2 and a neck 4. The neck 4 comprises an elongate member having a fingerboard surface 6 along its length and a heel 8 at one end of the neck 4. In accordance with the invention an adjustable mounting assembly 10 connects the neck 4 via the heel 8 to the instrument body 2 and more specifically to a support block 15 of the instrument body 2. Strings (not shown) are connected at one end to a head end (not shown) of the neck 4 and extend along the neck 4 above the fingerboard surface 6 and are attached at their opposite end to the instrument body 2. The adjustable neck mounting assembly 10 as will be described further below, adjustably connects the neck 4 to the instrument body 2, such that the neck 4 can be slidably adjusted vertically in a direction generally perpendicular to the strings and fingerboard surface 6 as shown by arrow C. As a result, the adjustable neck mounting assembly 10 operates as height adjuster, to adjust the height of the strings over the fingerboard surface 6, with it being noted that the strings are fixedly attached to the instrument body 2 to allow for this movement of the neck 4.

The front 14 of the instrument body 2 includes a recess 16 corresponding to a projecting end portion 18 of the neck 4 which extends and overlies a portion of the front of the instrument body 2, such that this extended portion 18 of the neck 4 can move within this recess 16. It should be noted that this can be contrasted with some conventional arrangements in which an extended portion 18 of the guitar neck 4 is more rigidly connected and/or abuts against the front of the instrument 2 which can cause stresses in the front 14 of the instrument body 2.

The adjustable neck mounting assembly 10 is shown in more detail in FIGS. 2 to 7. The adjustable neck mounting assembly 10 includes a neck mounting plate or carriage 20 which is attached to the heel 8 of the neck 4 and a body mounting plate or carriage 22 which is attached to the mounting block 15 of the instrument body. The neck mounting plate 20 and body mounting plate 22 are, as shown in FIGS. 3A and 3B, generally identical and indeed in one arrangement comprise the identical metal castings in order to reduce costs. There are preferably only slight differences in machining, and in particular in the threads, and handing of the threads, cut in the adjuster screw bosses as will be described further below.

Figure 7:
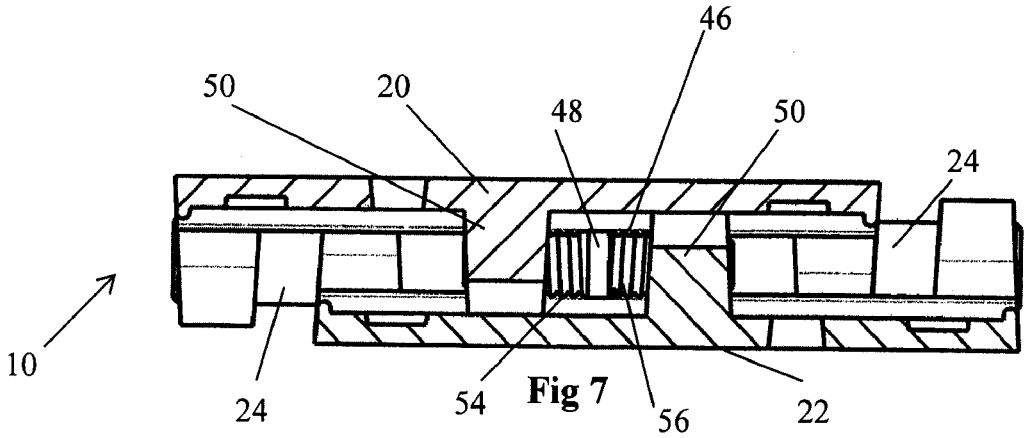
FIG. 7 is cross sectional view on section B-B of the adjustable neck mounting assembly shown in FIG. 4.
Figure 4:
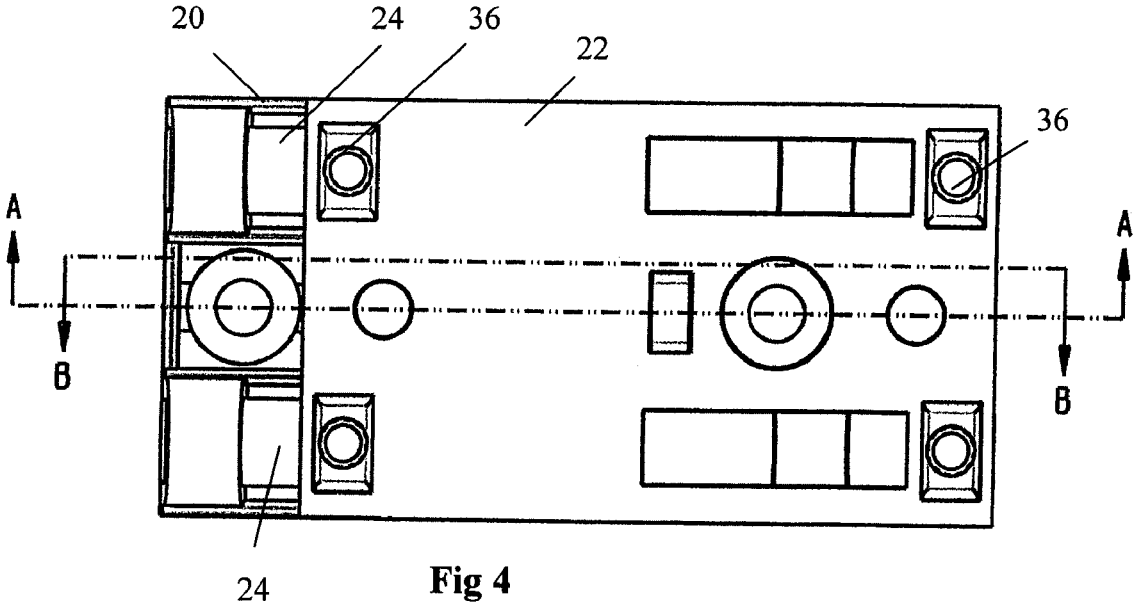
FIG. 4 is a view on the mounting plate of the assembled adjustable neck mounting assembly shown in FIG. 1.
Figure 6:
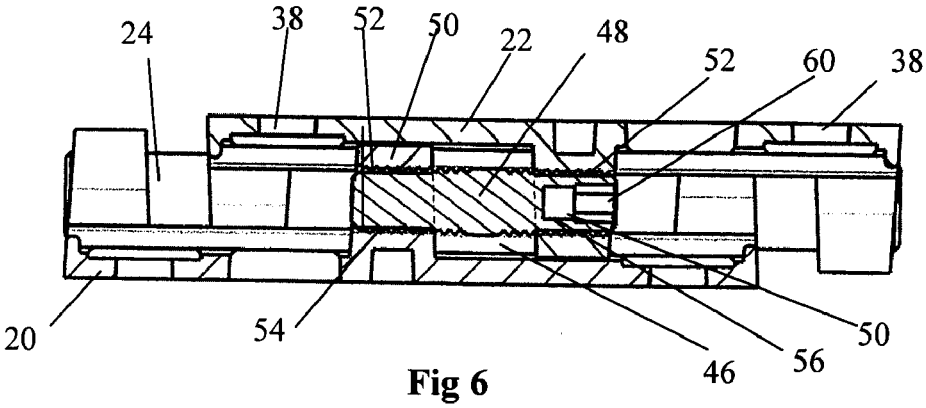
FIG. 6 is a cross sectional view on section A-A of the adjustable neck mounting assembly shown in FIG. 4.

As shown more clearly in FIGS. 5, 6 and 7, the mounting plates 20 and 22 when assembled are disposed parallel to and spaced apart overlying and facing each other. The mounting plates 20,22 each include two pairs of guide bosses 26 projecting from the mounting plates 20,22 and which include corresponding bores 28. Guide rods 24 are disposed and mounted spaced apart parallel to each other. The guide rod bosses 26 are located in line at opposite ends of the mounting plates 20,22 with bores 28 defined in the bosses 26 in line to receive and mount the guide rods 24. The guide rods 24 thereby, when assembled, slidingly connect the mounting plates 20,22 together. In particular the guide rods 24 when assembled in the assembly 10 are fixed to one of the mounting plates 20,22, in this case the body mounting plate 22 as discussed further below. The neck mounting plate 20 and bosses 26 then slide on and along the guide rods 24. In this manner the mounting plates 20,22 are held together with the guide rods 24 providing a rigid and strong connection whilst allowing the required movement between the mounting plates 20,22 to guide the movement between the neck 4 and body 2.

While a pair of guide rods 24, and guides, are used in this embodiment, and this is the preferred arrangement, it will be appreciated that in other arrangements only one guide rod 24, or more than two guide rods, could be used. It is also possible to use alternative guide arrangements, for example square guides or other track arrangements, to slidingly locate and guide the neck and body mounting plates 20,22.

A recess 30 is defined in the instrument body 2 and support block 15 to receive the adjustable neck mounting assembly 10, and in particular the body mounting plate 22. The body mounting plate 22 is attached to the support block 15 of the body 2 through four fasteners (not shown), for example bolts or screws, which extend through apertures 34 in the support block 15 (shown in FIG. 1) and extend through corresponding apertures 36 in the body mounting plate 22 to connect with the guide rod mounting bosses 26. The guide rod 24 further includes tapped holes 38 at locations corresponding to the fastener apertures 34,36 in the body 20 and mounting plate 22 and into which the distal ends of the fasteners are then engaged and screwed. Advantageously this arrangement also secures the guide rods 24 to the body mounting plate 22 as discussed above. It will be appreciated though that the body mounting plate 22 could be attached in other ways in other embodiments.

A recess 32 is also defined in the heel 8 to receive the adjustable neck mounting assembly 10, and in particular the neck mounting plate 20. In other embodiments, however, the adjustable neck mounting assembly 10 could be accommodated in a recess 30,32 in either of the neck heel 8 or body 2 rather than having recesses 30,32 in both.

The neck mounting plate 20 is attached to the heel 8 of the neck 4 using fasteners, for example bolts or screws, which extend through apertures 38 in to the centre of the neck mounting plate 20 and into corresponding apertures (not shown) in the heel 8. In this particular arrangement a bore 40 is defined in the neck heel 8 extending perpendicular to the fasteners and fingerboard surface 6 and interconnecting with apertures in the heel 8 for neck fasteners. A retainer rod 42 is fitted into this bore 40. The retainer rod 42 includes tapped holes 44 extending perpendicular to the axis of the retainer rod 40 and which are arranged to align with the neck fasteners, and apertures in the neck heel 8. The distal ends of the neck fasteners are engaged and screwed into these tapped holes 44 and fastener rod 40 to securely mount the neck mounting plate 30 to heel 8 of the neck 4. It will be appreciated that the neck mounting plate 20 could be attached in other ways to the heel 8 in other embodiments.

The adjustable neck mounting assembly 10 further includes an adjustment mechanism 46 which adjusts, sets and fixes the relative positions of the neck and body mounting plates 20,22 along the guide rods 24, and thereby sets and adjusts the position of the neck 4 relative to the body 2. The adjustment mechanism 46 comprises an adjuster screw 48 in the form of a dual threaded rod which is engaged in corresponding threaded bores 52 defined in respective adjustment bosses 50 located and projecting from the centres of each of the mounting plates 20,22. These mounting bosses 50, and bores 52, are axially aligned when the adjustable neck mounting assembly 10 is assembled and the mounting plates 20,22 are placed on top of each other. More specifically the adjuster screw 48 has a first, right-hand threaded portion 54, cut on one end and which is engaged in a right-hand thread cut in the bore 52 of the adjuster boss 50 of the neck mounting bracket 20, and a second opposite left-hand threaded portion 56 on the opposite end which is engaged in a left-hand threaded bore 52 in the adjuster boss 50 on the body mounting plate 22. This is most clearly shown in FIG. 6. In a variation threaded inserts (not shown) pre-cut with the threads could be fitted, and preferably keyed, into bores 52 in the bosses 50 rather than having the threads directly cut into the bores 52. Such inserts would in particular reduce the need for different machining of the mounting plates 20,22 with simply different threaded inserts being fitted to the respective plates 20,22.

Rotation of the adjuster screw 48 moves the screw axially with respect to both mounting plates 20,22 and both mounting plates 20,22 move relative to each other thereby adjusting the position of the neck 4 relative to the body 2. In particular the adjuster screw 48 moves axially with respect to both the body 2 and neck 4. Furthermore it will be appreciated that by this double threaded arrangement the adjustment is double acting, and that both mounting plates 20,22 will move in opposite directions when the adjuster screw 48 is rotated. This increases the adjustment movement provided as the adjuster screw 48 is rotated as compared to a single threaded arrangement. As a result there can be either increased movement, or more preferably the pitch of the threads can be reduced so increasing the frictional engagement of the threads and providing better locking and resistance to loosening of the adjuster screw 48 and assembly 10.

In use to adjust the adjustable neck mounting assembly 10 and position of the neck 2, an allen key or other suitable tool is inserted through an access opening 58, axially aligned with the adjuster screw 48, in the rear of the instrument body 2 or neck 4 which provides access to an end of the adjuster screw 48. A socket recess 60 adapted to receive the allen key, or other suitable tool for example screw driver or other type of key, is defined in the end of the adjuster screw 48 facing the back and opening 58. The adjuster screw 48 can then be rotated using the allen key, to adjust the adjustable neck mounting assembly 10 and position of the neck 2 relative to the body 4. It will be appreciated that alternatively this arrangement could be reversed with the access opening 58 being provided in the front of the body or neck and the other end of the adjuster screw 48, facing the front, including a socket recess 60. Indeed both arrangements could be included for additional flexibility. Such a front access opening is however perhaps less preferred since it will be covered by the strings and so slightly more difficult to access between the strings. It will also be appreciated that in other embodiments other arrangements could be provided to rotate the adjuster screw 48 and affect the required adjustment. For example a slot to receive a screwdriver could be defined in the end of the adjuster screw 48. Alternatively the end of the adjuster screw 48 may include a head portion shaped to be engaged by a socket tool. In a further variant a gear arrangement driving a gear on the adjuster screw 48 and connected to a drive gear and/or knob externally accessible and to rotate the screw 48 could be provided. In yet further variants the adjuster screw 48 may include an enlarged thumb wheel portion which projects through an enlarged aperture in the mounting plates 20,22 and neck heel 8 such that its outer periphery can be accessed and rotated to rotate the adjuster screw.

As shown the adjuster screw 48 is located in the centre of the assembly. As such it and the threads 54,56 are protected and enclosed by the mounting plates 20,22, and the assembly is self contained. It will however be appreciated that in other embodiments the adjuster screw 48 could extend axially to the ends of the assembly 10 and mounting plates or even beyond them even in some cases projecting beyond the rear of the body 2 through the opening 58 such that it can be directly accessed and rotated. Such arrangements are however less preferred, especially since the adjuster screw 48 projects from the rear of the instrument body 2 it may snag upon a player.

While adjuster screw 48 in this embodiment has threaded portions 54,56 at each opposite end, in other embodiments the oppositely threaded portions 54,56 may be provided along different sections of the adjuster screw 48. The pitches and diameters of the threaded portions 54,56 while in the preferred arrangement are the same to provide the same and balanced amount and degree of movement, the pitch and diameters of the threaded portions 54,56 may be different. In such a case the body and neck would move different amounts with respect to the adjuster screw 48 as the screw 48 is rotated. In addition while this embodiment utilises a single adjuster screw 48, in other embodiments multiple adjuster screws could be used and preferably rotated in unison.

It should be noted that the neck 4 includes a single, conventional type of heel 8. As such the neck is generally conventional, with the main modification begin the bore 40 for the fixing rod 42 and apertures for the neck fasteners to connect the neck mounting plate 20. Similarly the body 2 is generally conventional with the only, optional, modification being the cut-out recess 16. The recesses 30,32 to accommodate the adjustable neck mounting assembly 10 could be provided in one other of the neck heel 8 and body 2, or even omitted entirely with the assembly 10 being exposed. As such very little modification is required to the neck 4 and body 2 to accommodate the adjustable neck mounting assembly 10. In addition the adjustable neck mounting assembly 10 is a relatively self contained assembly that is simply and easily supplied and fitted to the neck 4 and instrument body 2.

The mounting plates 20,22, guide rods 24 and adjuster screw 48 are preferably all made from metal to provide sufficient strength and rigidity, with in particular the mounting plates 20,22 being cast. In other embodiments however any or all of these elements may be made from other suitable materials, such as plastic.

The adjustable neck mounting assembly 10 comprises a simple self contained assembly, that can be easily accommodated into an instrument 1, to adjustably and securely connect the neck 4 to the body 2 of the instrument. In particular the assembly 10 comprises only a few relatively simple parts, with both mounting plates 20,22 preferably being substantially identical and is easy to assemble.

Figure 8:
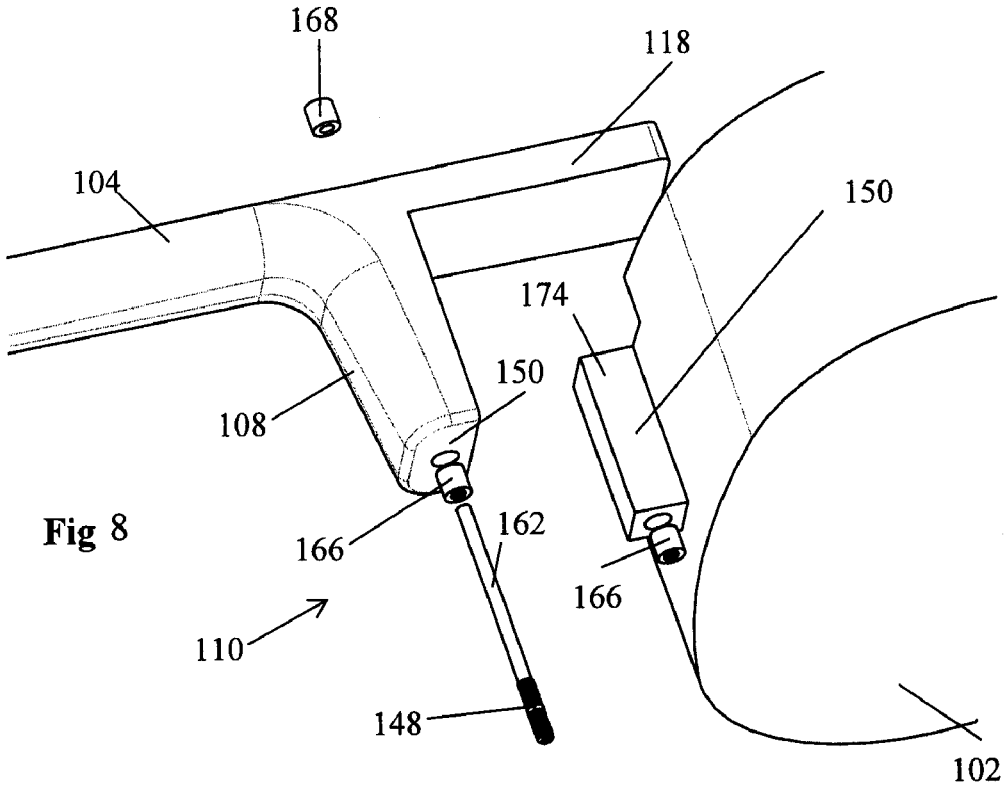
FIG. 8 is an exploded perspective part view of a stringed instrument body, neck and an adjustable neck mounting arrangement in accordance with an alternate embodiment of the invention.
Figure 9:
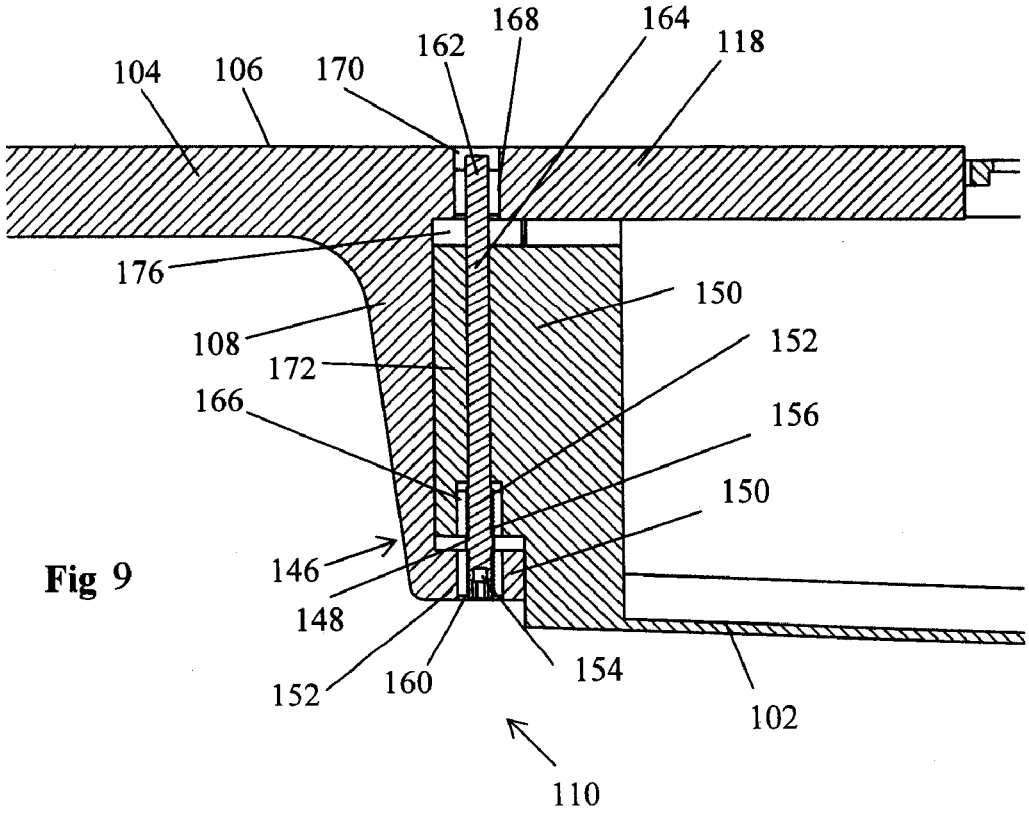
FIG. 9 is a cross sectional view of the assembled adjustable neck mounting arrangement shown in FIG. 8.

A variant and alternate embodiment, is shown in FIGS. 8 and 9, in which like reference numerals, incremented by 100 are used for corresponding features. In this embodiment the adjustable neck mounting assembly 110 is integrally incorporated into the stringed instrument 101 and neck 104 to body 102 joint. In other words the mounting plates 20,22 are incorporated into the neck and body of the instrument so reducing the number of components. In this case an adjuster boss 150 is integrated with the body 102 and in particular is part of the neck mounting block 115. An adjuster boss 150 is also integrated and formed as part of the neck 104, and in particular heel 108. Oppositely threaded bores 152 are then defined in each of these bosses to receive an adjuster screw 148 having oppositely threaded ends portion 154,156. In this variant threaded inserts 166 are fitted into bores in the bosses 150 to provide the corresponding threaded bores 152 rather than having the threads directly cut into the bores 152.

As shown in this embodiment the adjustment mechanism 146 is located towards the rear of the body, and so the end of the screw adjuster 148 is more readily accessible and includes a slot 160 which can be engaged through the threaded bore 152 by a screw driver. Alternatively the adjustment mechanism 146 could be located more centrally or towards the front. The arrangement of the bosses 150 could also be reversed with the body boss 150 being located toward the rear and the neck boss located towards the front.

An end of the adjusted screw 148 is extended to integrally and additionally form a guide bearing support rod 162 that extends along a guide bore 164 in the body 102 and has an opposite end engaged in a bearing insert 168 located in a bore 170 in the neck 104. This integrally provides a guide and guides the sliding movement of the neck and body. Additional guide bearing support rods may be located in other bores (not shown) defined in the adjuster boss 150 of the body 102, and parallel to the adjuster bore 152, and may be used in addition to, or instead of a central guide bearing support rod 162 in the adjuster bore 152. In addition a recess 172 is defined in the heel 108 of the neck 104. This recess 172 is dimensioned so as to receive the adjuster boss 150 of the body, with side wall 174 of the adjuster boss 150 slidingly abutting against corresponding side walls 176 of the recess 172 so as to slidingly locate and guide movement of the boss 150 within the recess and so movement of the neck and body. In a further variant the side wall 174 and recess 170 may have more intricate profiles so as to be even more positively keyed together. This arrangement provides an integral guide. In other variants this integral guide arrangement could also be omitted, and/or the support rod 162 omitted. In addition other guide arrangements, or even no guide arrangement could be used. It is however preferable to incorporate some form of guide and additional engagement of the neck 104 and body 102 in addition to the adjustment mechanism 146.

Various other modifications will be apparent to those skilled in the art, and features of the various embodiments may be variously utilised and combined in other further embodiments. For example a mounting plate 20,22 could be used and attached to the neck or body, with then an integral boss 150 provided on the other of the neck or body, in a hybrid of the embodiments shown.

The principle and mode of operation of this invention have been explained and illustrated in its preferred embodiment. However, it must be understood that this invention may be practised otherwise than as specifically explained and illustrated without departing from its spirit or scope, and many other modifications of the exact details of embodiments of this invention will be apparent to those skilled in the art.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An adjustable mounting assembly for mounting a neck to a body of a stringed instrument, the assembly comprising:

a first mounting adapted to be mounted to the neck of the stringed instrument;

a second mounting adapted to be mounted to the body of the stringed instrument; and an adjuster mechanism interconnecting the first and second mountings and adapted to adjust and fix, in use, the relative position of the first and second mountings;

wherein the adjuster mechanism comprises a rotatable screw threaded member having a first threaded portion that is engaged in a corresponding threaded boss of the first mounting, and a second oppositely threaded portion that is engaged in a corresponding threaded boss of the second mounting.

2. An adjustable mounting assembly according to claim 1 wherein the first and second threaded portions are provided at opposite ends of the screw threaded member.

3. An adjustable mounting assembly according to claim 1 wherein the first threaded portion and corresponding threaded boss have a right-hand thread, and the second threaded portion and corresponding boss have an opposite left-hand thread.

4. An adjustable mounting assembly according to claim 1 wherein the corresponding threaded boss of the first and/or second mounting comprises a threaded insert that is attached to the respective first and/or second mounting.

5. An adjustable mounting assembly according to claim 1 wherein the screw threaded member is located in between the first and second mountings.

6. An adjustable mounting assembly according to claim 1 wherein the screw threaded member is located centrally in between the first and second mountings.

7. An adjustable mounting assembly according to claim 1 wherein the first mounting is slidingly engaged with the second mounting.

8. An adjustable mounting assembly according to claim 1 further comprising at least one guide attached to one of the first or second mountings and along which the other mounting is moveably guided.

9. An adjustable mounting assembly according to claim 8 wherein the at least one guide comprises at least one guide rod attached to the first or second mounting, and axially along which the other of the second or first mounting is slidingly engaged.

10. An adjustable mounting assembly according to claim 8 wherein the at least one guide comprises a pair of spaced apart parallel guides.

11. An adjustable mounting assembly according to claim 10 wherein the screw threaded member is located between the pair of parallel guides.

12. An adjustable mounting assembly according to claim 8 wherein the screw threaded member is located parallel to the at least one guide.

13. An adjustable mounting assembly according to claim 1 wherein the screw threaded member comprises an end that is configured to receive and engage a corresponding suitable tool.

14. An adjustable mounting assembly according to claim 13 wherein the end of the screw threaded member comprises a socket, head or slot adapted to be engaged by a corresponding tool.

15. An adjustable mounting assembly according to claim 1 wherein the first and second mountings are substantially identical, and are formed from an identical casting.

16. A stringed instrument comprising:

an instrument body;

an instrument neck; and an adjustable mounting assembly comprising a first mounting connected to the instrument neck, a second mounting connected to the instrument body, and an adjuster mechanism interconnecting the first and second mountings and configured to adjust and fix, in use, the relative position of the first and second mountings, wherein the adjuster mechanism comprises a rotatable threaded member having a first threaded portion that is engaged in a corresponding threaded boss of the first mounting, and a second oppositely threaded portion that is engaged in a corresponding threaded boss of the second mounting.

17. A stringed instrument according to claim 16 wherein the neck includes a heel, and the first mounting of the adjustable mounting is connected to said heel.

18. A stringed instrument according to claim 16 wherein a recess is defined in the neck and/or body for receiving the adjustable mounting assembly.

19. A stringed instrument according to claim 16 further comprising an access opening in the neck or body for providing access to, in use rotate the threaded member.

20. A stringed instrument according to claim 16 wherein the neck comprises a fingerboard surface and the adjustable mounting assembly connects the neck to the body such that the neck is adjustable in a direction generally perpendicular to the fingerboard surface.

21. A stringed instrument according to claim 16 wherein the first mounting is integrated into and is an integral part of the instrument neck.

22. A stringed instrument according to claim 21 wherein the second mounting is integrated into and is an integral part of the instrument body.

23. A stringed instrument according to claim 16 wherein the second mounting is integrated into and is an integral part of the instrument body.

* * * * *